United States Patent [19]

Berg

[11] 4,237,077

[45] Dec. 2, 1980

[54] AUTOMATIC CHOKE SYSTEM

[75] Inventor: Peter G. Berg, Norton, Mass.

[73] Assignee: Texas Instruments Incorporated, Dallas, Tex.

[21] Appl. No.: 937,896

[22] Filed: Aug. 29, 1978

[51] Int. Cl.[3] ..... F02M 1/12

[52] U.S. Cl. ..... 261/39 E; 123/588 F; 236/101 C; 337/107

[58] Field of Search ..... 261/39 E; 123/119 F; 236/101 C; 337/104, 107

[56] References Cited

U.S. PATENT DOCUMENTS

| | | | |
|---|---|---|---|
| 2,835,766 | 5/1958 | Few | 333/107 |
| 3,752,133 | 8/1973 | Irish | 261/39 E |
| 3,806,854 | 4/1974 | Armstrong | 261/39 E |
| 3,813,630 | 5/1974 | Dalzell | 333/107 |
| 3,972,311 | 8/1976 | De Petris | 261/39 E |
| 4,050,424 | 9/1977 | Nelson | 261/39 E |
| 4,050,427 | 9/1977 | Hollins | 261/39 E |
| 4,058,097 | 11/1977 | Silverstein | 261/39 E |
| 4,083,336 | 4/1978 | Armstrong et al. | 261/39 E |
| 4,131,657 | 12/1978 | Ball, Jr., et al. | 261/39 E |

FOREIGN PATENT DOCUMENTS

| | | | |
|---|---|---|---|
| 73136293 | 10/1973 | Sweden | 261/39 E |

OTHER PUBLICATIONS

Oldsmobile Service Manual, 1978 Chassis, pp. 6C1-34 and 6C1-35.

*Primary Examiner*—Tim R. Miles

*Attorney, Agent, or Firm*—James P. McAndrews; John A. Haug; Melvin Sharp

[57] ABSTRACT

An automatic choke system of modular construction has self-regulating heaters arranged to heat a thermostatic spring to adjust a choke valve during start-up of an automotive engine. Heat storing and transferring means are located between the heaters and spring to provide heat-transfer paths of different lengths between the respective heaters and the spring for providing the thermostatic spring with non-linear heat up to improve the smoothness of initial engine operation while also minimizing the period of fuel-enriched operation during start-up. The same heat storing and transferring means is also provided with a large heat storing capacity for continuing to transfer heat to the spring after termination of engine operation to prevent any substantial fuel enrichment by the choke system if the engine should be restarted before selected portions of the engine cool below selected fuel vaporizing temperatures.

13 Claims, 5 Drawing Figures

AUTOMATIC CHOKE SYSTEM

Automatic choke systems conventionally include a spiral thermostatic spring which urges an unbalance-mounted, air-movable choke valve in the air-fuel induction passage of a carburetor toward a closed position in the passage with a force which increases as a function of decreases in the temperature of the spring. When the spring applies a selected force, the valve restricts air entry to the passage and furnishes a fuel enriched air-fuel mixture to an engine so that the engine tends to run smoothly during its start-up period even though the engine may be too cold to fully vaporize the fuel being furnished to the engine. A pair of self-regulating electrical resistance heaters transfer heat to the spring for progressively reducing its choke valve closing force and for permitting the valve to move to an open position in the passage in response to the flow of air through the passage against the valve. The first heater is energized when engine operation is initiated and the second heater is energized when a thermally responsive switch is actuated above a predetermined ambient temperature. In such conventional choke systems, the spring begins to receive heat from the first heater promptly after the engine is started so that the choke valve closing force is reduced to eliminate the fuel enrichment within a selected period of time on a cold day when the engine has been properly warmed up. If the engine is started when ambient temperature is above the noted level, the spring promptly receives heat from both heaters for more quickly reducing the choke valve closing force of the spring.

In using such conventional systems, it is found that the initial heating of the thermostatic spring tends to significantly reduce the choke valve closing force of the spring. Accordingly, if the engine is sharply accelerated shortly after engine start-up, the flow of air against the choke valve could result in excessive leaning of the air-fuel mixture and could cause rough operation or even stalling of the engine. It would be desirable if an automatic choke system could assure that the initially high level of fuel enrichment provided on a cold day were maintained for a sufficiently long period of time to assure smooth start-up operation of the engine while still being adapted to reduce the choke valve closing force of the spring to eliminate such fuel enrichment within substantially the same total length of time as in previously known choke systems.

In using conventional choke systems it has also been found that the thermostatic spring tends to cool much more rapidly than the engine when the heaters are deenergized at termination of the engine operation. As a result, if the engine is restarted after the thermostatic spring has cooled but while the engine is still warm, the choke system tends to provide unnecessary fuel enrichment which is wasteful of fuel, which produces escessive and unnecessary exhaust emission of air pollutants, and which can even result in flooding of the engine. Racing of the engine can also occur particularly where fast idle cam means are also operated in response to movement of the thermostatic spring. It would be desirable if the choke system could prevent unnecessary fuel enrichment on engine restarting and would be adapted to restore fuel-enriching choke valve closing force to the spring only after cool down of the engine.

It is an object of this invention to provide a novel and improved automatic choke system for an automotive engine; to provide such a system which assures that a properly fuel enriched air-fuel mixture is furnished to the engine for a sufficient period of time after engine start-up on a cold day to assure smooth operation of the engine until the engine is warmed up; to provide such a system which terminates any fuel enrichment in the mixture being furnished to the engine promptly after warm-up of the engine is completed; to provide such an improved choke system which prevents furnishing of a fuel enriched air-fuel mixture to the engine on restarting of the engine unless the engine has cooled sufficiently to require such fuel enrichment; and to provide such an improved choke system having a construction which is adapted to be readily modified to match the choke valve operating times of the system to the warm-up and cool-down characteristics of various automotive engines.

Briefly described, the novel and improved automatic choke system of this invention comprises a pair of self-regulating electrical resistance heaters of positive temperature coefficient of resistivity arranged to heat a spiral thermostatic spring. The first heater is adapted to be energized when operation of an automotive engine is initiated and the system includes a thermally responsive switch which is actuable above a predetermined ambient temperature to energize the second heater.

Novel heat-transfer means are disposed between the heaters and the spring for receiving and storing heat from the heaters and for transferring that heat to the spring. Those novel heat-transfer means define a first heat-transfer path of selected effective length between the first heater and the spring and also define a second, much shorter heat transfer path between the second heater and the spring. Preferably for example, the first heater is mounted on a relatively thick heat-sink plate and the second heater is mounted on a relatively thin heat sink plate. The two heat sink plates are then secured together and the thermostatic spring is mounted at one side of the thin heat sink plate to form the desired two different heat-transfer paths.

In that arrangement, when the first heater is energized on engine start-up on a cold day, the actual transfer of heat to the thermostatic spring begins only with a selected delay after the engine starting. That is, the heat initially received from the first heater by the heat-transfer means is transferred to the spring only with a delay after engine starting as the heat is conducted along the relatively long first heat-transfer path. As a result, the initial choke valve closing force of the thermostatic spring is maintained for a time after engine start-up to assure proper fuel enrichment and smooth engine operation during the start-up period. However, when the engine is started on a warm day, heat from the second heater is promptly transferred to the thermostatic spring for substantially immediately initiating reduction of the choke valve closing force of the spring for assuring prompt termination of fuel enrichment by the choke system.

In the novel and improved choke system of this invention, the heat transfer means are also proportioned to have a substantial heat storing capacity and are arranged to be fully heated by the heaters during operation of the automobile engine. Accordingly, the heat transfer means are adapted to continue to transfer heat to the thermostatic spring for a substantial period of time after operation of the engine is terminated so that, for at least a major part of the time before the engine cools down, the thermostatic spring is maintained at a temperature which would prevent any substantial fuel enrichment by the choke system if the engine should be restarted within that time.

Other objects, advantages and details of the novel and improved automatic choke system of this invention appear in the following detailed description of preferred embodiments of the invention, the detailed description referring to the drawings in which.

Figure 1:
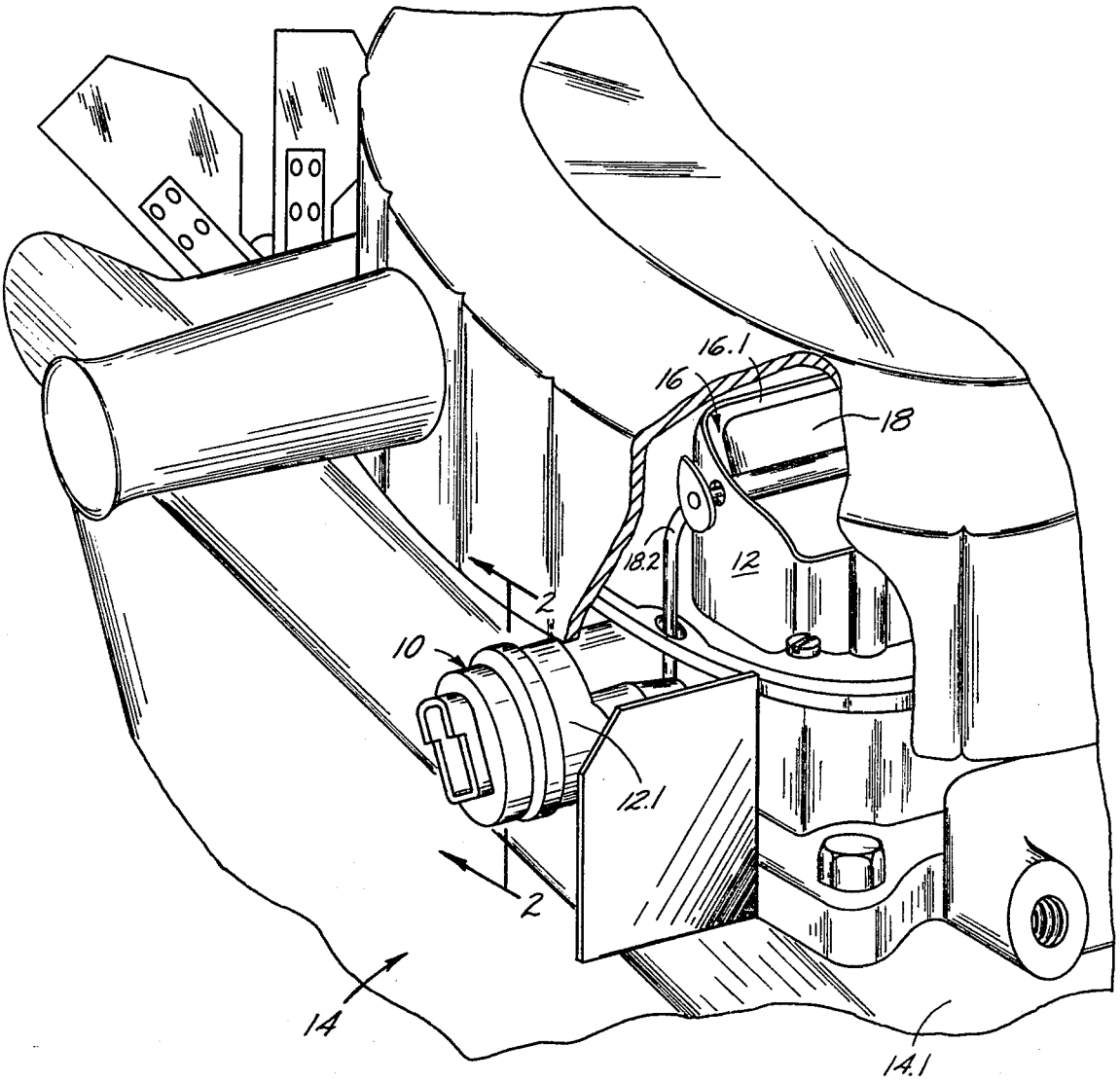
FIG. 1 is a partial perspective view of an automotive engine having a carburetor mounted thereon and having the novel and improved automotive choke control of the invention arranged to regulate operation of the choke valve on the carburetor.
Figure 2:
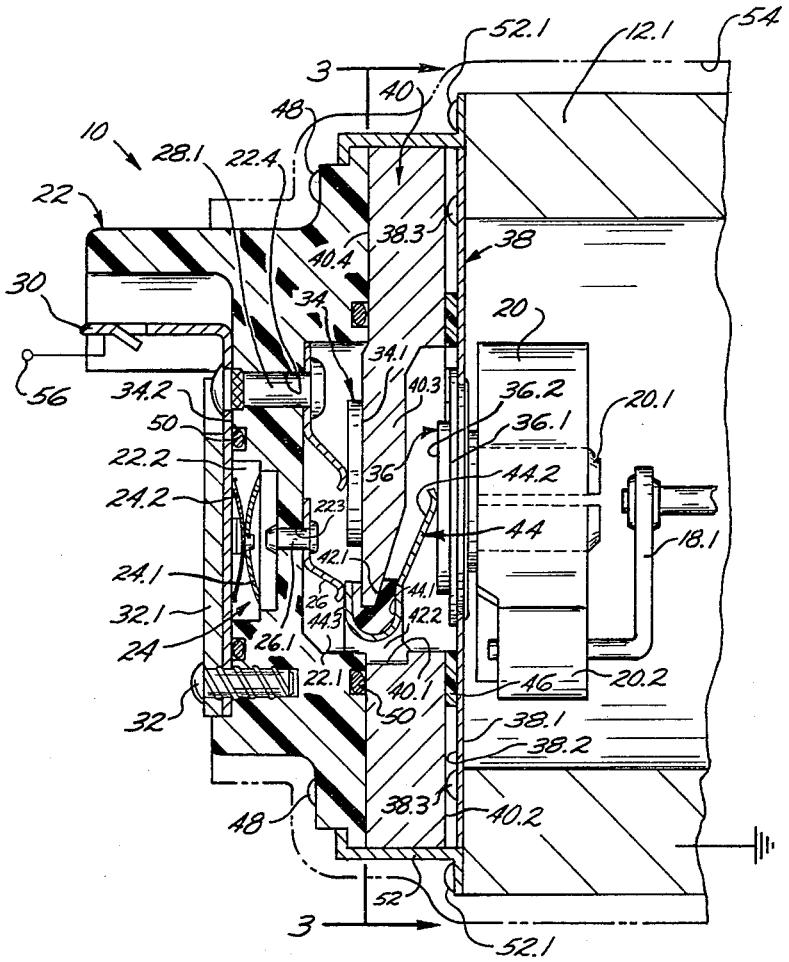
FIG. 2 is a section view along line 2—2 of FIG. 1.
Figure 3:
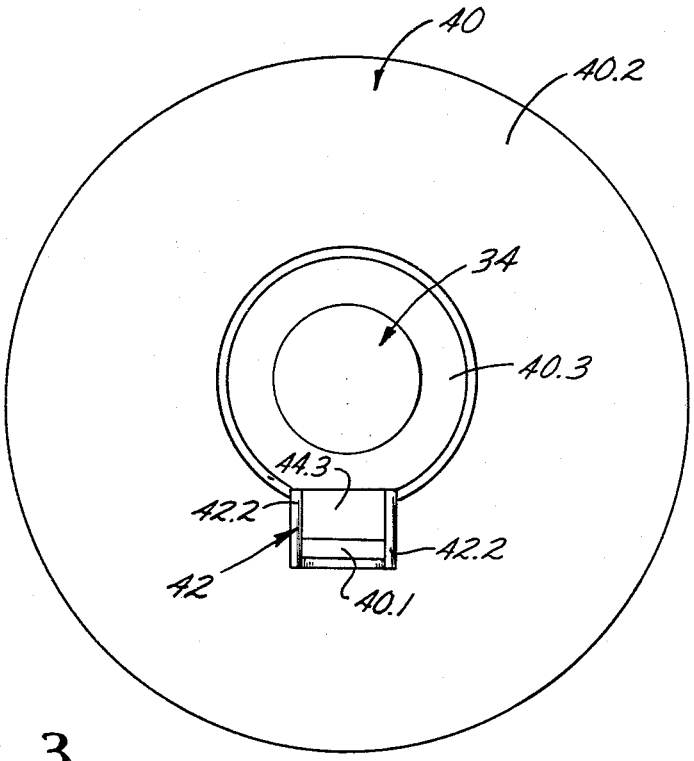
FIG. 3 is a section view along line 3—3 of FIG. 2.

Referring to the drawings, 10 in FIGS. 1 and 2 indicates the novel and improved automatic choke control for an automotive engine provided by this invention. The control is shown mounted on a carburetor 12 on a typical internal combustion automotive engine 14. The carburetor 12 is fully conventional and, as will be understood, includes an air-fuel induction passage 16 which is open at one end 16.1 to admit air to the passage and which is connected at its opposite end to the intake manifold 14.1 of the engine in conventional manner. In that arrangement, the carburetor is adapted to furnish an air-fuel mixture to the engine through the passage, and throttle means (not shown) are selectively movable in the carburetor for regulating the volume of the air-fuel mixture furnished to the engine.

As will be understood, air-fuel intake portions of the engine such as the intake manifold 14.1 and the like become heated during operation of the engine so that as the air-fuel mixture being furnished to the engine passes over those engine portions the fuel constituent of the mixture is assured of being fully vaporized. However, those engine portions typically require up to about six minutes to reach that full vaporizing temperature when operation of the engine is initiated on a cold day when ambient temperature is on the order of 0° F. or below. On the other hand, those air-fuel intake portions of the engine also typically remain at or above that selected fuel vaporizing temperature for as much as 20–30 minutes or more after termination of engine operation even on a fairly cold day.

Accordingly, the carburetor 12 has a conventional unbalance mounted, air-movable choke valve 18 mounted in the air-fuel induction passage 16 of the carburetor for variable movement across the passage 16 to control air flow through the passage. A conventional bell crank 18.1 is mounted in the choke mounting housing 12.1 of the carburetor and linkage 18.2 connects the bell crank to the choke valve 18 for rotating the choke valve in response to rotation of the bell crank in conventional manner. Typically for example, the choke valve 18 is adapted to be rotated from a position which substantially closes the air-fuel induction passage 16 and wherein the valve extends at an angle of a few degrees to the axis of the passage to a position which substantially opens the passage and wherein the valve extends substantially parallel to the passage axis. In that arrangement the choke valve is adapted to be disposed in a closed position in the passage 16 when the engine is initially started up, whereby the entry of air into the passage is restricted and the air-fuel mixture furnished to the engine by the carburetor is enriched so that even if the fuel constituent is not fully vaporized by the noted air-fuel intake portions of the engine, the mixture is still adapted to provide suitably smooth operation of the engine. On the other hand, the choke valve is adapted to be moved to a fully open position in the passage 16 so that the carburetor supplies a lean air-fuel mixture to the engine after the noted air-fuel intake portions of the engine have heated to the noted fuel vaporizing temperature and when enrichment of the air-fuel mixture being furnished to the engine is no longer required. In that way, the choke valve is adapted to save fuel and to reduce the amount of unburned hydrocarbons and other pollutants which are emitted to the atmosphere in the engine exhaust.

In accordance with the invention, the choke control 10 includes a conventional thermostatic bimetal spiral coil spring 20 which is fixed at one end to a stud 20.1 and which has a tang 20.2 at its opposite end which is connected to the bell crank 18.1 for adjusting the choke valve 18. That is, the spring 20 is operably connected to the choke valve for urging the choke valve toward a closed position in the passage 16 with a force which increases as a function of decreases in the temperature of the spring from a predetermined temperature level. The spring is normally adapted to dispose the choke valve in the closed position in the passage 16 but when heated to reduce the choke valve closing force of the spring permits opening of the valve by the flow of air through the passage 16 against the valve.

In accordance with this invention, the choke control 10 further includes a housing 22 of phenolic material or other rigid electrical insulating material having a first recess 22.1 formed in one side of the housing and having a second recess 22.2 formed in the opposite side of the housing. A thermally responsive electrical switch 24, comprising a snap-acting electrically conductive bimetal disc 24.1 and a spider spring 24.2 or the like, is disposed in the housing recess 22.2 as shown in FIG. 2. A spring terminal 26 is secured in the recess 22.1 by a rivet 26.1 which extends through an aperture 22.3 in the housing into recess 22.2. A second spring terminal 28 is secured in the recess 22.1 by a second rivet 28.1. The second rivet extends through an aperture 22.4 in the housing and further secures a plate terminal 30 to the housing over the recess 22.2 and electrically connects that terminal 30 to the spring terminal 28. An additional screw 32 preferably extends through terminal 30 to further secure the terminal 30 and a terminal insulator 32.1 to the housing. In that arrangement, the terminal 30 is adapted to be connected to a battery or other electrical power source on the automotive engine by closing of the engine ignition switch or the like (not shown) whenever the engine 14 is in operation, thereby to direct electrical current to the spring terminal 28 when the engine is being operated. The snap acting disc 24.1 is normally spaced from the rivet 26.1 so that the terminal 30 does not normally direct electrical current to the spring terminal 26. However, the snap-acting disc 24.1 is adapted to be actuated and to move to an inverted domed configuration from that shown in FIG. 2 when the disc is heated above a predetermined ambient temperature such as 70° F. When that occurs, the disc electrically engages the rivet 26.1 and electrically connects that rivet to the terminal 30 through the disc 24.1 and the spider spring 24.2 for directing electrical current to the spring terminal 26.

The choke control 10 additionally comprises first and second electrical resistance heaters 34 and 36. The control also comprises heat-transfer means including the metal heat-sink plates 38 and 40 which are disposed between the heaters and the thermostatic spring 20, which receive and store heat from the heaters, and which transfer such heat to the spring 20. In accordance with this invention, the heat-transfer means define a first heat-transfer path of substantial length between the first heater 34 and the spring 20 as is illustrated in FIG. 2 and also define a second, much shorter heat-transfer path between the second heater 36 and the spring 20.

In a preferred embodiment of the invention, each of the electrical resistance heaters 34 and 36 is of the self-regulating type formed of a ceramic material or the like which has a positive temperature coefficient of resistivity (PTC) and which is adapted to display a sharp, anomolous increase in resistivity when self-heated to a selected temperature for limiting further increase in the temperature of the heater. Typically for example, the heaters each comprise a disc element of a lanthanum-doped barium titanate or the like having a diameter of 0.300 to 0.800 inches and a thickness of about 0.050 inches and having metal contact layers (not shown) on opposite surfaces 34.1–34.2 and 26.1–36.2 of the elements to make ohmic contact to the ceramic material and to serve as terminals of the heater elements. As such PTC heaters are well known, they are not further described and it will be understood that each heater displays only 1–3 ohms resistance when electrical current is directed through the element at room temperature but displays about 20–30 ohms resistance when self-heated to a temperature of about 120° C. or the like at which the heater temperature stabilizes.

In the preferred embodiment of the invention, the first heat-sink plate 38 is very thin and the fixed end of the spiral thermostatic coil spring 20 is secured at one side 38.1 of the plate by the stud 20.1 so that the coil convolutions lie along said one side of the plate. The second heater 36 is mounted at the opposite side 38.2 of the plate at a central location on the plate. Typically, the stud 20.1 which secures the spring to the plate also mounts the heater element 36 on the back of the stud as illustrated in FIG. 2. Preferably the ohmic contact layer on one side 36.1 of the second heater element is electrically connected to the plate 38 by a conductive adhesive or solder or the like (not shown) and preferably the thin plate has spacer bumps 38.3 distributed around the perimeter of the plate side 38.2.

The second heat sink plate 40 is relatively much thicker than the plate 38 and has a central recess or opening 40.1 in the plate. One side 40.2 of the plate is disposed in heat transfer relation to said opposite side 38.2 of the thin heat sink plate, preferably by being abutted against the spacers 38.3, and the central recess or opening 30.1 is fitted around the second heater 36 as is shown in FIG. 2. A tang or platform part 40.3 of the plate extends over the recess or opening 40.1 from the opposite side 40.4 of the plate and the first heater element 34 is preferably mounted on that tang or platform-part of the plate. Preferably the ohmic contact layer formed on one side 34.1 of the first heater is electrically connected to the plate 40 by a conductive adhesive or solder or the like (not shown).

In a preferred embodiment of the invention, an electrical insulator 42 of a relatively stiff organic material has a groove 42.1 receiving an edge of the tang or platform part 40.3 of the thicker heat sink plate and has wings 42.2 press-fitted into the opening 40.1 in the plate for securing the insulator in the plate opening 40.1. A spring conductor or jumper 44 has a bight portion 44.1 gripping the insulator and has one end 44.2 electrically engaged with the ohmic contact surface on the opposite side 36.2 of the second heater element whereby the conductor extends through the opening 40.1 in electrically insulated relation to the plate 40 to dispose the opposite end 44.3 of the conductor to be accessible at the side 40.4 of the plate. The plates 38 and 40 are formed of materials of high thermal conductivity such as aluminum or copper or lower thermal conductivity such as low carbon or stainless steel materials as may be desired.

In a preferred embodiment of this invention, a gasket ring 46 of thermally insulating material is disposed between selected portions of the heat-sink plates 38 and 40 as shown in FIG. 2 for restricting heat-transfer between those plates to a desired extent. Rivets 48 or the like then secure the housing 22, the heat sink plate 40, and the heat sink plate 38 together in any conventional manner so that the gasket 46 is secured between the two heat sink plates, so that O-ring gaskets 50 are clamped between the housing and the plate 40 and between the housing and terminal 30 and so that the heat-sink plates are electrically connected together in selected heat-transfer relation to each other and to the thermostatic spring 20. The first heater 34 is spaced from the spring 20 by a heat-transfer path of substantial effective length extending across the platform part 40.3 of the plate 40, through the plate 40, through the restricted spacer bumps 38.3 and the plate 38 to the spring 20. The second heater 36 is spaced from the spring 20 by a much shorter heat-transfer path extending through the stud 20.1 or the thin plate 38. The gaskets 46 and 50 seal the heater elements 34 and 36 within the control 10 to protect the elements from the surrounding atmosphere. The attachment of the housing 22 to the heat sink plates also holds the spring terminal 26 in electrical engagment with the end 44.3 of the conductor 44 and holds the spring terminal 28 in electrical engagement with the ohmic contact layer on the side 34.2 of the first heater element.

In accordance with this invention, strap means 52 are attached by screws 52.1 to the choke mounting housing 12.1 on the carburetor and extend over portions of the housing 22 for adjustably mounting the choke control 10 on the carburetor in conventional manner so that the tang 20.2 on the thermostatic spring engages the bell crank 18.1 of the choke valve linkage and so that the heat sink plates 38 and 40 are connected to electrical ground through the housing 12.1 in conventional manner. Preferably as is indicated only in FIG. 2 by the broken lines 54, a sleeve of polyurethane foam or other thermal insulating material is preferably disposed over the choke control 10, and preferably over part of the choke mounting housing 12.1, for surrounding the heaters 34 and 36, the heat sink plates 38 and 40, the spring 20 and the thermally responsive switch 24.

In that arrangement, when the engine 14 is started on a cold day, the thermostatic spring 20 urges the choke valve 18 to its closed position so that a fuel-enriched air-fuel mixture is furnished to the engine and so that the engine runs smoothly even though the air-fuel intake portions 14.1 and the like of the engine are not at the temperature at which they assure full vaporization of the fuel being furnished to the engine. The terminal 30 of the choke control 10 is connected to an electrical power source indicated by the lead 56 in FIG. 2 on closing of the engine ignition switch or the like when the engine is started. Accordingly electrical current is directed through rivet 28.1, terminals 28, heater 34, plates 40 and 38 and through the mounting housing 12.1 to electrical ground for energizing the heater 34 as soon as motor operation is initiated. Since the ambient temperature is low, the thermally responsive switch 24 is not actuated and the second heater 36 is not energized. In that situation, heat generated by heater 34 is transferred to the plate 40 and tends to spread out through the plate to be gradually transferred into and through the plate 38 to the thermostatic spring 20. Since the heat-transfer path between the first heater and the spring is of substantial effective length, the actual transfer of heat into the spring 20 occurs only with a selected delay after the initiation of engine operation. Accordingly the spring 20 continues to apply its initial choke-valve-closing force to the valve 18 during that delay and the choke system continues to furnish the initial degree of fuel enrichment for assuring smooth engine operation even if the engine should be sharply accelerated shortly after engine start-up. Thereafter, heat continues to be transferred to the spring 20 so that the choke valve is subsequently permitted to open to eliminate such fuel enrichment when the noted air-fuel intake portions of the engine have been heated to their desired fuel vaporizing temperature.

Alternately, if the engine is started when ambient temperature is above the actuating temperature of the thermally responsive switch 24, that switch is closed when engine operation is initiated. Electrical current is therefore directed through terminal 30, spring 24.2, snap-disc 24.1, rivet 26.1, terminal 26, conductor 44, heater 36, plate 38 and through mounting housing 12.1 to electrical ground for energizing heater 36 as soon as the engine is started. In that situation, heat is transferred from the heater 36 through plate 38 to the spring 20. Since that heat-transfer path between the second heater and the spring is relatively short, the actual transfer of heat into the spring 20 occurs promptly after the initiation of engine operation and reduction of the choke-valve-closing force of the spring promptly begins. The heaters 34 and 36 then cooperate is heating the spring so that the enrichment of the fuel being furnished to the engine is quickly eliminated. In a preferred embodiment of this invention, heat-transfer means in the choke control 10 also define a third heat-transfer path between the first heater 34 and the thermally responsive switch 24, whereby, when the engine 14 is started on a cold day while the switch 24 is unactuated, heat from the heater 34 is conducted to the switch for actuating the switch after a desired period of time to energize the second heater 36. Preferably the control 10 is proportioned so that heat from the heater 34 is transferred through the rivets 26.1 and 28.1 and the like so that the switch 24 is actuated after the actual transfer of heat from the first heater 34 to the spring 20 has begun and before heat from the heater 34 has heated the spring to its full choke opening temperature. In that way, the second heater 36 is adapted to cooperate with the first heater in completing opening of the choke once the choke adjustment period has begun.

In accordance with this invention, the heat-transfer means in the choke control 10 are provided with sufficient heat storage capacity to continue to transfer heat to the spring 20 for a substantial period of time after operation of the engine 14 is terminated, whereby, for at least a major part of the delay period before the noted air-fuel intake portions 14.1 and the like of the engine cool below their noted fuel vaporizing temperature, the spring 20 is maintained at a temperature which prevents any substantial fuel enrichment if the engine should be restarted during that cool down period. In that way the choke contol 10 tends to avoid fuel waste, to avoid excessive emission of exhaust pollutants, and avoid possible flooding of the engine during such restarting.

Typically for example, the plates 38 and 40 have thicknesses of 0.025 and 0.200 inches respectively and each have a diameter of about 2.0 inches. Thus, in providing the desired different heat-transfer paths between the heaters 34 and 36 and the spring 20, the plates also provide the control 10 with substantial heat-storage capacity. Therefore particularly when the thermal insulating gasket is disposed between the plates 38 and 40 for restricting heat transfer from the plate 40 to the plate 38 it is found that the heat sink plates continue to transfer heat to the spring 20 to maintain that spring at a choke opening temperature for a major part of the time during which the air-fuel intake protions 14.1 and the like of the engine remain above their desired fuel vaporizing temperature. Further, if the control 10 is enclosed in the thermal insulating sleeve 54 for retaining heat within the control after the termination of engine operation, the heat-sink means maintain the spring 20 at that choke opening temperature for substantially the entire cool down period of the engine.

Figure 4:
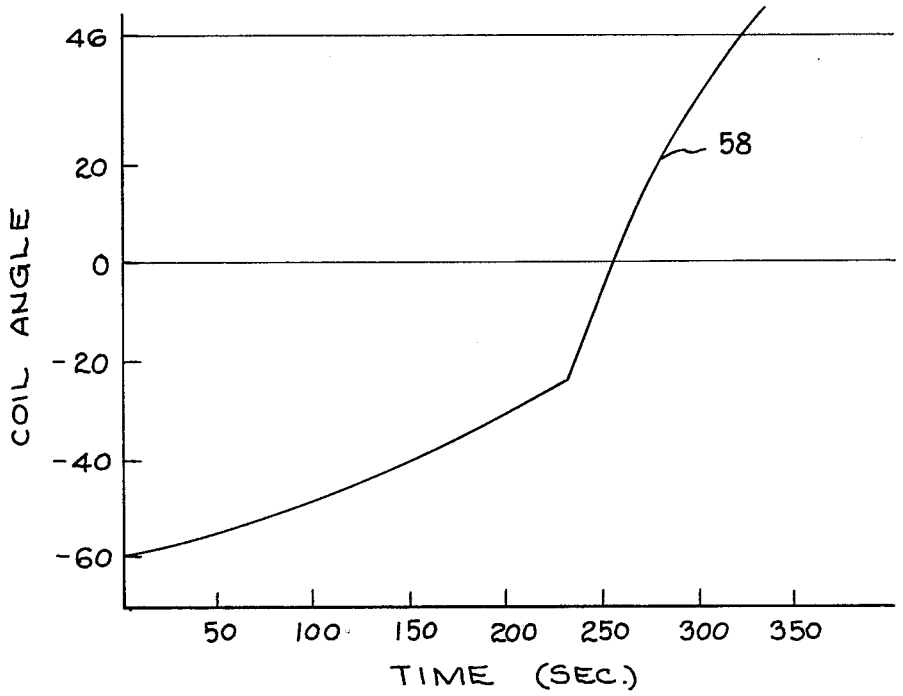
FIGS. 4 and 5 are graphs illustrating characteristics of the choke control system of this invention.

In a typical embodiment of the invention, where the heater 34 in the choke control 10 is energized at 0° F., the tang 20.2 of the thermostatic spring is initially disposed at an angle of −60° relative to a selected reference point as indicated by curve 58 in FIG. 4 and, for a brief period after the heater 34 is energized, the spring tang substantially retains its initial position as heat is being transferred through the heat sink plates 38 and 40. Even by the end of about four minutes after energization of the heater 34, the coil tang 20.2 has moved through an angle less than about 40°. However, in that period, heat from the heater 34 heats the thermally responsive switch 24 to its actuation temperature for energizing the second heater 36, whereby the two heaters thereafter cooperate in heating the coil to move the coil tang through an additional angle of more than 65° in about two additional minutes. The choke control 10 is thus adapted to provide an initial delay in reducing the choke valve closing force of the spring 20 after energization of the heater 34 on a cold day to assure smooth engine operation but is thereafter adapted to reduce the spring force rapidly to eliminate fuel enrichment by the choke valve in about six minutes in an ambient temperature of about 0° F.

Figure 5:
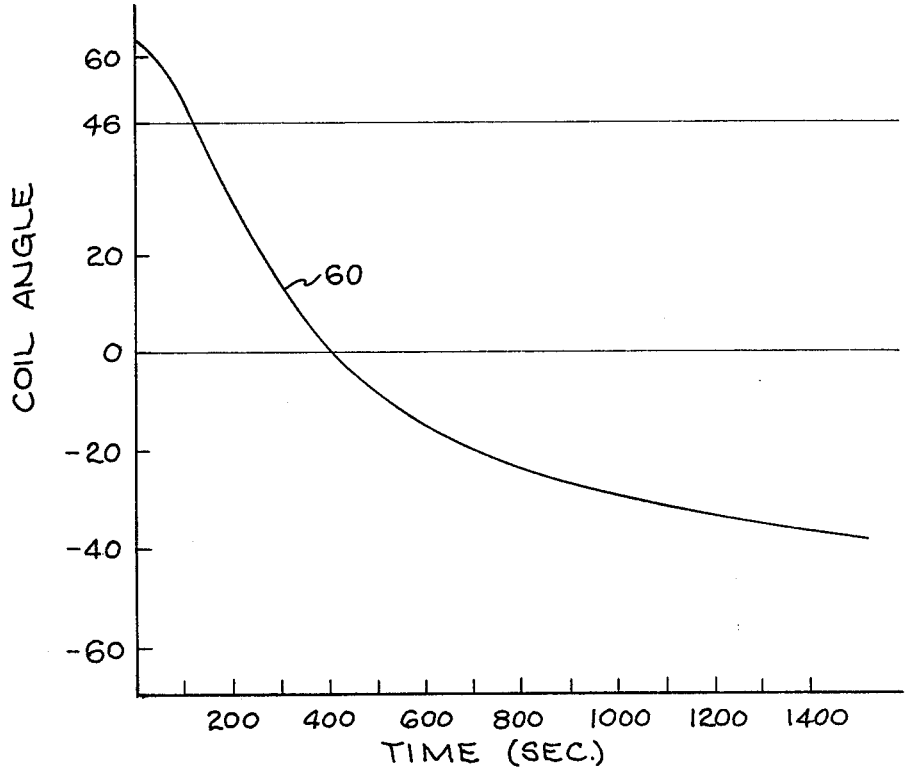

Then, subsequently, when the heaters 34 and 36 are deenergized in the ambient temperature of 0° F. while the spring 20 and the heat-sink plates 38 and 40 are fully heated so that the coil tang 20.2 is disposed at an angle of about +60° as is indicated by curve 60 in FIG. 5, the heat sink plates store sufficient heat to continue to transfer heat to the spring 20 for a substantial period of time after the heaters are deenergized. Thus, even where the thermally insulating sleeve 56 is omitted from the control 10, the heat-transferred to the spring retains the coil tang at an angle of −15° for about 10 minutes as indicated by curve 60. Thus, the choke control 10 is adapted to maintain the spring 20 with a substantially reduced choke valve closing force for at least a major part of the time before the air-fuel intake portions of an engine using the choke control would cool below their fuel vaporizing temperatures. Further, where the thermal insulating sleeve 54 is used around the choke control, the control is adapted to retain the spring 20 with a substantially reduced choke valve closing force for substantially the entire cool down period of the engine.

The choke control 10 is also characterized by its modular construction as described above wherein the ratings of the heaters 34 and 36 and the proportions of the heat sink plates 38 and 40 are relatively variable for matching the warm-up and cool down characteristics of various engines while still being economically combined with the housing 22.

It should be understood that although particular embodiments of this invention have been described by way of illustrating this invention, the invention includes all modifications and equivalents of the described embodiments falling within the scope of the appended claims.

I claim:

1. In combination with an internal combustion engine having air-fuel portions which warm above a selected temperature during engine operation and assure full vaporization of the fuel in an air-fuel mixture being furnished to the engine and which tend to cool below that temperature within a delay period after termination of engine operation, an electrical power source, and a carburetor having an air-fuel induction passage furnishing an air-fuel mixture to the engine and having an unbalance-mounted, air-movable choke valve mounted for variable movement across the passage to control air flow through the passage, a choke control system comprising thermostatic spring means urging the choke valve toward a closed position in the passage with a force increasing as a function of decreases in the temperature of the spring means from a predetermined level to provide a fuel enriched air-fuel mixture to the engine on a first initiation of engine operation, electrical heater means operable from said power source during operation of the engine, and heat storing and transferring means disposed between the heater means and spring means for receiving and storing heat from the heater means and for transferring such heat to the spring means to reduce the choke valve closing force of the spring means and permit sufficient opening of the valve by the flow of air through the passage against the valve to substantially eliminate such fuel enrichment after said engine portions have become heated to said selected temperature, said heat storing and transferring means having sufficient heat storage capacity to continue to transfer heat to the spring means for a time after termination of engine operation so that for a major part of said delay period the spring means are maintained at a temperature preventing any substantial fuel enrichment of the air-fuel mixture on a restarting of the engine, said heater means comprising a first heater device operable on initiation of engine operation, a second heater device, and thermally responsive switch means actuable above a predetermined ambient temperature to operate the second heater device, said heat storing and transferring means having one side lying along said spring means to transfer heat to the spring means, having a first surface portion with a selected spacing from said one side having said first heater device secured in heat-transfer relation thereto defining a first heat-transfer path of a selected length between the first heater device and the spring means for initiating heat transfer to the spring means with a selected delay after the initiation of engine operation when ambient temperature is below said predetermined ambient temperature, and having a second surface portion with a relatively much smaller spacing from said one side having said second heater device secured in heat transfer relation thereto defining a second, relatively much shorter heat-transfer path between the second heater device and the spring means for initiating heat-transfer to the spring means promptly after the initiation of engine operation when ambient temperature is above said predetermined ambient temperature.

2. A choke control system as set forth in claim 1 wherein said heat-transfer means defines a third heat-transfer path between the first heater device and the thermally responsive switch means for heating the switch means to the actuation temperature thereof, said third heat-transfer path being adapted to transfer sufficient heat to the switch means when the ambient temperature is below said predetermined ambient temperature for actuating the switch means to initiate operation of the second heater device after the initiation of heat-transfer to the spring means has begun and before the spring means have been heated to the temperature at which said fuel enrichment of the air-fuel mixture has been substantially eliminated.

3. In combination with an internal combustion engine having air-fuel portions which warm above a selected temperature during engine operation and assure full vaporization of the fuel in an air-fuel mixture being furnished to the engine and which tend to cool below that temperature within a delay period after termination of engine operation, an electrical power source, and a carburetor having an air-fuel induction passage furnishing an air-fuel mixture to the engine and having an unbalance-mounted, air-movable choke valve mounted for variable movement across the passage to control air flow through the passage, a choke control system comprising thermostatic spring means urging the choke valve toward a closed position in the passage with a force increasing as a function of decreases in the temperature of the spring means from a predetermined level to provide a fuel enriched air-fuel mixture to the engine on a first initiation of engine operation, electrical heater means operable from said power source during operation of the engine, said heater means comprising a first heater device operable on initiation of engine operation, a second heater device, and thermally responsive switch means actuable above a predetermined ambient temperature to operate the second heater device, and heat-transfer means disposed between the heater means and spring means for receiving and storing heat from the heater means and for transferring such heat to the spring means to reduce the choke valve closing force of the spring means and permit sufficient opening of the valve by the flow of air through the passage against the valve to substantially eliminate such fuel enrichment after said engine portions have become heated to said selected temperature, said heat-transfer means defining a first heat-transfer path of a selected length between the first heater device and the spring means for initiating heat transfer to the spring means with a selected delay after the initiation of engine operation when ambient temperature is below said predetermined ambient temperature, said heat-transfer means defining a second, relatively much shorter heat-transfer path between the second heater device and the spring means for initiating heat-transfer to the spring means promptly after the initiation of engine operation when ambient temperature is above said predetermined ambient temperature, said heat-transfer means having sufficient heat storage capacity to continue to transfer heat to the spring means for a time after termination of engine operation so that for a major part of said delay period the spring means are maintained at a temperature preventing any substantial fuel enrichment of the air-fuel mixture on a restarting of the engine, said choke control system having a modular construction wherein said heat storing and transferring means includes a first relatively thin heat sink plate mounting said second heater device in closely spaced heat-transfer relation to the thermostatic spring means, and a second relatively much thicker heat-sink plate secured in heat-transfer relation to the first plate, the second plate mounting the first heater device in relatively greater spaced relation to the thermostatic spring means.

4. A choke control system as set forth in claim 3 wherein the spring means comprise a spiral thermostat coil, the first heat sink plate mounts the coil at one side of the first plate, the second heater device comprises a self-regulating electrical resistance heater element of a ceramic material of positive temperature coefficient of resistivity secured in heat-transfer relation to the first plate at the center of the opposite side of the first plate, the second heat sink plate has one side secured in heat transfer relation to said opposite side of the first plate, has a central opening fitted around said second heater device, and has a tang extending from the opposite side of the second plate over said opening, and said first heater device comprises a self-regulating electrical resistance element of a ceramic material of positive temperature coefficient of resistivity secured to said tang in heat transfer relation to the second plate.

5. A choke control system as set forth in claim 4 having selected thermal insulating means secured between portions of said first and second heat-sink plates for limiting the rate of heat-transfer between said plates.

6. A choke control system as set forth in claim 4 wherein said heat sink plates respectively connect one side of the heater elements to electrical ground, a conductor is connected to the other side of the heater element on the first plate and extends through the opening in the second plate in electrically insulated relation to the second plate, and housing means of electrical insulating material mount the thermally responsive switch means connected to the power source and mount additional terminal means connected to the power source, said housing means being secured to said opposite side of the second heat sink plate connecting the switch means to said conductor and connecting the additional terminal means to the other side of the heater element on the second heat sink plate.

7. A choke control system as set forth in claim 6 having thermal insulation means surrounding the heat sink plates, heater elements and thermostatic coil spring to retain heat therein so that the heat-transfer means continues to transfer heat to the spring for a sufficient time after termination of engine operation so that substantially throughout said full delay period the spring is maintained at a temperature preventing any substantial fuel enrichment of the air-fuel mixture on such restarting of the engine.

8. A choke control for use with a carburetor having an air-fuel induction passage for furnishing an air-fuel mixture to an engine and having an unbalance mounted, air-movable choke valve mounted for variable movement across the passage to control air-flow through the passage comprising thermostatic spring means urging the choke valve toward a closed position in the passage with a force increasing as a function of decreases in the temperature of the spring means from a predetermined level for providing a fuel enriched air-fuel mixture to the engine on initiation of engine operation, a first electrical heater operable on initiation of engine operation, a second electrical heater, thermally responsive switch means actuable above a predetermined ambient temperature for energizing the second heater, and heat storing and transferring means disposed between the heaters and spring means for receiving heat from the heaters and for transferring such heat to the spring means to reduce the choke valve closing force of the spring means and permit opening of the choke valve by the flow of air through the passage against the valve to substantially eliminate such fuel enrichment, said heat storing and transferring means having one side lying along said spring means to transfer heat to the spring means, having a first surface portion with a selected spacing from said one side having said first heater secured in heat-transfer relation thereto defining a first heat-transfer path of selected length between the first heater and the spring means for initiating heater transfer to the spring means with a selected delay after the initiation of engine operation when ambient temperature is below said predetermined ambient temperature, and having a second surface portion with a relatively much smaller spacing from said one side having said second heater secured in heat-transfer relation thereto defining a second, relatively much shorter heat-transfer path between the second heater and the spring means for initiating heat transfer to the spring means promptly after the initiation of engine operation when ambient temperature is above said predetermined ambient temperature.

9. A choke control as set forth in claim 8 wherein said heat-transfer means defines a third heat-transfer path between the first heater and the thermally responsive switch means for heating the switch means to the actuation temperature thereof, said third heat-transfer path being adapted to transfer sufficient heat to the switch means when the ambient temperature is below said predetermined ambient temperature for actuating the switch means to initiate operation of the second heater device after the initiation of heat-transfer to the spring means has begun and before the spring means have been heated to the temperature at which said fuel enrichment of the air-fuel mixture has been substantially eliminated.

10. A choke control for use with a carburetor having an air-fuel induction passage for furnishing an air-fuel mixture to an engine and having an unbalance mounted, air-movable choke valve mounted for variable movement across the passage to control air-flow through the passage comprising thermostatic spring means urging the choke valve toward a closed position in the passage with a force increasing as a function of decreases in the temperature of the spring means from a predetermined level for providing a fuel enriched air-fuel mixture to the engine on initiation of engine operation, a first electrical heater operable on initiation of engine operation, a second electrical heater, thermally responsive switch means actuable above a predetermined ambient temperature for energizing the second heater, and heat-transfer means disposed between the heaters and spring means for receiving heat from the heaters and for transferring such heat to the spring means to reduce the choke valve closing force of the spring means and permit opening of the choke valve by the flow of air through the passage against the valve to substantially eliminate such fuel enrichment, said heat-transfer means defining a first heat-transfer path of selected length between the first heater and the spring means for initiating heat transfer to the spring means with a selected delay after the initiation of engine operation when ambient temperature is below said predetermined ambient temperature, said heat-transfer means defining a second, relatively much shorter heat-transfer path between the second heater and the spring means for initiating heat transfer to the spring means promptly after the initiation of engine operation when ambient temperature is above said predetermined ambient temperature, said control having a modular construction wherein said heat-transfer means include a first, relatively thin heat sink plate mounting said second heater in closely spaced heat-transfer relation to the thermostatic spring means, and a second relatively much thicker heat-sink plate secured in heat-transfer relation to the first plate, the second plate mounting the first heater in relatively greater spaced relation to the thermostatic spring means.

11. A choke control system as set forth in claim 10 wherein the spring means comprise a spiral thermostat coil, the first heat sink plate mounts the coil at one side of the first plate, the second heater comprises a self-regulating electrical resistance heater element of a ceramic material of positive temperature coefficient of resistivity secured in heat-transfer relation to the first plate at the center of the opposite side of the first plate, the second heat sink plate has one side secured in heat transfer relation to said opposite side of the first plate, has a central opening fitted around said second heater, and has a tang extending from the opposite side of the second plate over said opening, and said first heater comprises a self-regulating electrical resistance element of a ceramic material of positive temperature coefficient of resistivity secured to said tang in heat transfer relation to the second plate.

12. A choke control system as set forth in claim 11 having selected thermal insulating means secured between portions of said first and second heat-sink plates for limiting the rate of heat-transfer between said plates.

13. A choke control system as set forth in claim 11 wherein said heat sink plates respectively connect one side of the heater elements to electrical ground, a conductor is connected to the other side of the heater element on the first plate and extends through the opening in the second plate in electrically insulated relation to the second plate, and housing means of electrical insulating material mount the thermally responsive switch means to be connectable to a power source and mount additional terminal means to be connectable to the power source, said housing means being secured to said opposite side of the second heat sink plate connecting the switch means to said conductor and connecting the additional terminal means to the other side of the heater element on the second heat sink plate.

* * * * *